US005915153A

United States Patent [19]

Kim et al.

[11] Patent Number: 5,915,153

[45] Date of Patent: Jun. 22, 1999

[54] IMAGE PRINTING APPARATUS

[75] Inventors: Wan-ha Kim; Kee-son Chang; Jin-geun Kwak, all of Suwon, Rep. of Korea

[73] Assignee: Samsung Electronics Co., Ltd., Kyungki-do, Rep. of Korea

[21] Appl. No.: 09/119,939

[22] Filed: Jul. 21, 1998

[30] Foreign Application Priority Data

Aug. 23, 1997 [KR] Rep. of Korea ..... 97-40349

[51] Int. Cl.[6] ..... G03G 15/10

[52] U.S. Cl. ..... 399/249; 399/226; 399/345

[58] Field of Search ..... 399/71, 223, 225, 399/226, 231, 233, 249, 237, 239, 345

[56] References Cited

U.S. PATENT DOCUMENTS 5,713,068 1/1998 Teschendorf et al. ..... 399/249

*Primary Examiner*—Arthur T. Grimley
*Assistant Examiner*—Hoang Ngo
*Attorney, Agent, or Firm*—Sughrue, Mion, Zinn Macpeak & Seas, PLLC

[57] ABSTRACT

An image printing apparatus includes a photoreceptor belt on which a latent electrostatic image is formed, and a plurality of development devices for developing the latent electrostatic image formed on the photoreceptor belt. Each of the development devices has a development roller for coating a developer liquid on the photoreceptor belt, and a squeegee roller for removing excess developer liquid from the photoreceptor belt. A roller driving means drives the squeegee rollers, and an elevating means elevates the development devices. The plurality of development devices are supported by a pair of frames that are spaced apart a predetermined distance from each other. The roller driving means commonly drives the squeegee rollers of the development devices. The frame elevating means displaces the pair of frames, such that the squeegee rollers are simultaneously in contact with or out of contact with the photoreceptor belt.

7 Claims, 6 Drawing Sheets

IMAGE PRINTING APPARATUS

BACKGROUND OF THE INVENTION

1. Field of the Invention

The present invention relates to an image printing apparatus in which a plurality of development devices are incorporated in a frame structure and having a simplified driver.

2. Description of the Related Art

In general, an image printing apparatus: (1) forms a latent electrostatic image on a photosensitive medium, such as a photoreceptor drum or a photoreceptor belt; (2) develops the latent electrostatic image using a toner having predetermined colors; and (3) transfers the developed image onto a sheet of paper.

Referring to FIG. 1, in a conventional liquid image printing apparatus, a photoreceptor belt 110 circulates around first, second and third rollers 121, 122 and 123. A charging station 135, for electrically initializing the photoreceptor belt 110, is positioned in the vicinity of the moving area of the photoreceptor belt 110 between the first and second rollers 121 and 122. A plurality of laser scanning units (LSUs) 130*a*–130*d* and a plurality of development devices 140*a*–140*d* are alternately installed in the vicinity of the moving area of the photoreceptor belt 110 between the second and third rollers 122 and 123. Each of the LSUs 130*a*–130*d* forms a latent electrostatic image on the photoreceptor belt 110 by irradiating a laser beam onto a photosensitive region of the photoreceptor belt 110 according to an image signal that corresponds to a color to be printed. Each of the development devices 140*a*–140*d* develops the latent electrostatic image formed by the associated LSU into a toner image by applying a developer liquid to the photosensitive region. The developer liquid includes a liquid carrier mixed with a toner of a predetermined color. Typical toner colors include yellow (Y), magenta (M), cyan (C) and black (BK).

A drying roller 124 opposes the third roller 123, such that the photoreceptor belt 110 interposes therebetween. The drying roller removes the liquid carrier remaining on the photoreceptor belt 110. A heat roller 125 contacts the drying roller 124 and evaporates the liquid carrier thereon. Thus, the toner image is dried as the photoreceptor belt 110 moves across the third roller 123.

A transfer roller 126 opposes the first roller 121, such that the photoreceptor belt interposes therebetween. As the photoreceptor belt 110 moves across the first roller, the transfer roller 126 lifts the toner image from the photoreceptor belt 110 and transfers it onto a recording sheet 128. The recording sheet 128 is pressed against the transfer roller 126 by a pressing roller 127 that opposes the transfer roller 126.

Referring to FIG. 2, the development device 140*a* contains a developer liquid 149*a* having a liquid carrier mixed with a toner having a predetermined color. The development device 140*a* includes a development roller 142, a first squeegee roller 145 and a second squeegee roller 147 installed along the traveling direction of the photoreceptor belt 110. A cleaning roller 143 opposes the development roller 142.

A developer liquid supplier 144 supplies the developer liquid 149*a* between the development roller 142 and the photoreceptor belt 110. The development roller 142 applies the developer liquid 149*a* to the latent electrostatic image formed on the photosensitive surface of the photoreceptor belt 110. The cleaning roller 143 removes the developer liquid 149*a* remaining on the surface of the development roller 142. The first and second squeegee rollers 145 and 147 remove excess developer liquid 149*a* remaining on the photoreceptor belt 110. The developer liquid on the surfaces of the first and second squeegee rollers 145 and 147 is removed by first and second blades 146 and 148.

Referring to FIG. 3, during application of the developer liquid 149*a*, the development roller 142 rotates in the same direction as the traveling direction of the photoreceptor belt 110 and is spaced apart a predetermined distance from the photoreceptor belt 110. The length of the development roller 142 spans across the width of the photosensitive region of the photoreceptor belt 110. Thus, the developer liquid is applied to the photosensitive region of the photoreceptor belt 110, as well as to edge portions of the photoreceptor belt 110 outside of the photosensitive region.

The first squeegee roller 145 squeegees the photosensitive region of the photoreceptor belt 110 to remove excess developer liquid therefrom. The first squeegee roller 145 rotates in the same direction as the traveling direction of the photoreceptor belt 110. The first blade 146 is spaced apart a predetermined distance from the first squeegee roller 145. The developer liquid on the surface of the first squeegee roller 145 drips to the bottom of the development device by gravitational forces. After passing across the first squeegee roller 145, some developer liquid 149*c* remains on the photosensitive region as a toner image corresponding to the latent electrostatic image, and some developer liquid remains on the edge portions of the photoreceptor belt 110.

The developer liquid on the edge portions of the photoreceptor belt 110 is known as wrap-around developer liquid 149*b*. The wrap-around developer liquid 149*b* is removed from the photoreceptor belt 110 by the second squeegee roller 147 rotating in a reverse direction to the traveling direction of the photoreceptor belt 110. The wrap-around developer liquid 149*b* is separated from the surface of the second squeegee roller 147 by the second blade 148 contacting the surface of the second squeegee roller 147.

Referring to FIG. 4, the development roller 142 moves away from the photoreceptor belt 110 after applying the developer liquid 149*a*. At this time, a drip line 149*d* is formed on the surface of the photoreceptor belt 110. Such drip lines 149*d* are problematic in that they cause image blots and other print defects. Therefore, the drip line 149*d* must be removed by the first squeegee roller 145. As noted before, the first squeegee roller 145 normally rotates in the same direction as the traveling direction of the photoreceptor belt 110. However, as shown in FIG. 5, when the drip line 149*b* approaches the first squeegee roller 145, the first squeegee roller 145 rotates in the reverse direction to remove the drip line 149*b*. At this time, the first blade 146 moves toward and contacts the first squeegee roller 145 to remove the developer liquid therefrom. The first squeegee roller 145 and first blade 146 then return to their initial positions.

Conventionally, the drip line removal process described above is performed at predetermined time intervals by the respective development devices 140*a*–140*d* in a sequential fashion.

Referring to FIG. 6, in a conventional image printing apparatus, a plurality of development devices are driven independently. Thus, the development devices 140*a*–140*d* are respectively supported on frames 141*a*–141*d*. The frames 141*a*–141*d* respectively include roller driving motors 151*a*–151*d* for driving the development roller 142, the first squeegee roller 145 and the second squeegee roller 147, respectively. Pairs of cams 162*a*–162*d* are provided to elevate the respective frames 141*a*–141*d*, and cam driving motors 161*a*–161*d* are provided for respectively driving the pairs of cams 162*a*–162*d*.

The conventional apparatuses have a complex structure. Thus, it is difficult to disassemble and assemble during repair, and the costs associated with such structures are high.

SUMMARY OF THE INVENTION

An object of the present invention is to provide an image printing apparatus having a simplified structure which can be disassembled and assembled easily. Another object of the present invention is to provide an image printing apparatus having an image forming device in which the manufacturing costs are low.

Accordingly, the present image printing apparatus comprises: a photoreceptor belt on which a latent electrostatic image is formed; a plurality of development devices for developing the latent electrostatic image formed on the photoreceptor belt, each of the development devices having a development roller for applying a developer liquid onto the photoreceptor belt, and a squeegee roller for removing excess developer liquid from the photoreceptor belt; a roller driving means for driving the squeegee rollers; an elevating means for elevating the development devices; wherein the plurality of development devices are supported by a pair of frames that are spaced apart a predetermined distance from each other, the roller driving means commonly drives the squeegee rollers of the development devices, the frame elevating means displaces the pair of frames, such that the squeegee rollers (1) simultaneously contact the photoreceptor belt, and (2) simultaneously separate from the photoreceptor belt.

The roller driving means includes a driving gear installed on the shaft of the driving motor, a plurality of linkage gears simultaneously rotated by the driving gear, and driven gears rotating in engagement with all the linkage gears and installed on the shafts of the respective squeegee rollers.

The elevating means includes a cam driving motor, a plurality of cams rotated by the cam driving motor, for displacing the pair of frames, and two cam shafts provided under the pair of frames with a predetermined space in a traversing direction of the frames. The cams are coupled to both ends of each of the two cam shafts, such that a cam on each of the two cam shafts slidingly contacts a lower portion of each of the frames.

According to the present invention, the drip lines generated during development of an image are simultaneously removed by four development devices. Unlike conventional apparatuses, four development devices are supported on an integrated frame, and the driving devices employ only two driving motors and only four cams.

The above and other features of the invention including various and novel details of construction and combination of parts will now be more particularly described with reference to the accompanying drawings and pointed out in the claims. It will be understood that the particular image printing apparatus embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENTS

Figure 1:
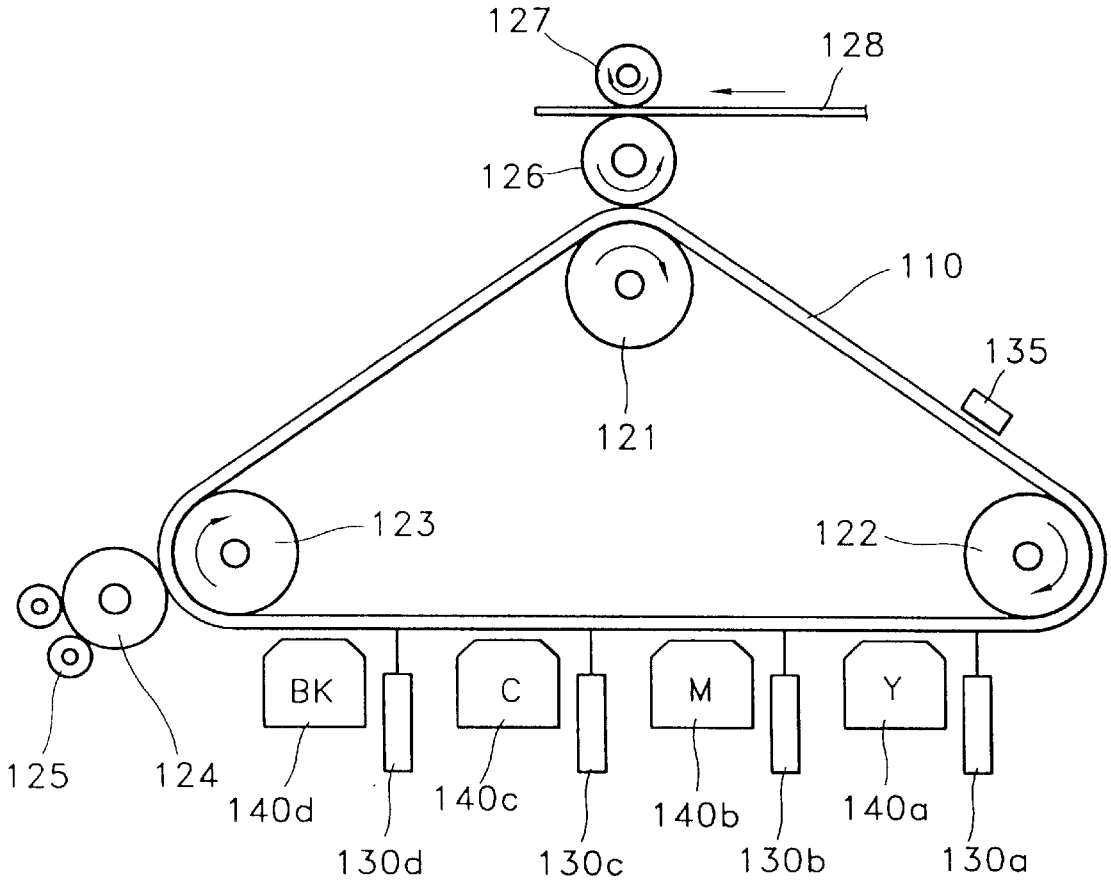
FIG.1 (PRIOR ART)
FIG. 1 is a schematic partial showing of a conventional image printing apparatus.
Figure 2:
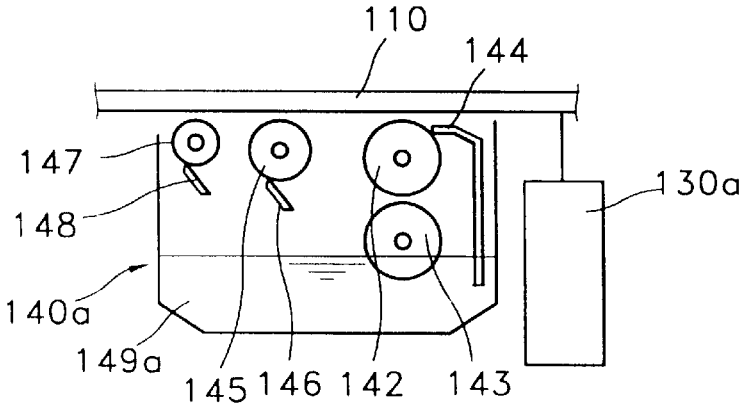
FIG.2 (PRIOR ART)
FIG. 2 is a schematic showing of the internal structure of a development device shown in FIG. 1.
Figure 3:
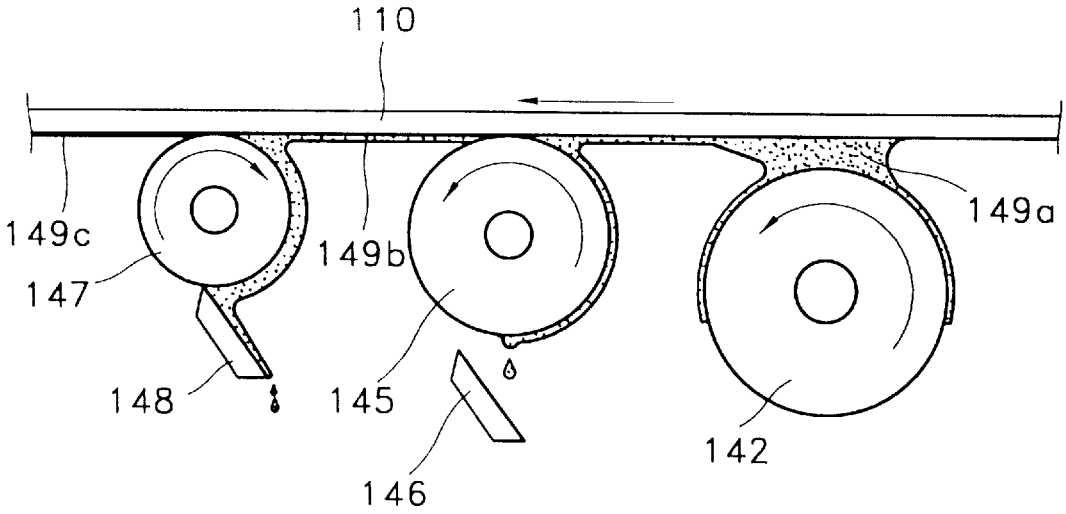
FIG.3 (PRIOR ART)
FIG. 3 is a schematic diagram of a development system for the conventional image printing apparatus.
Figure 4:
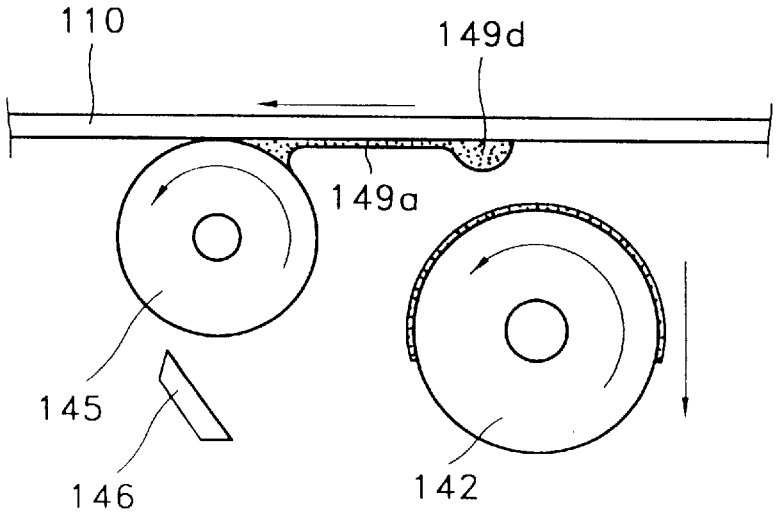
FIG.4 (PRIOR ART)
FIGS. 4 and 5 illustrate the process of removing drip lines formed on a photoreceptor belt in the conventional image printing apparatus.
Figure 5:
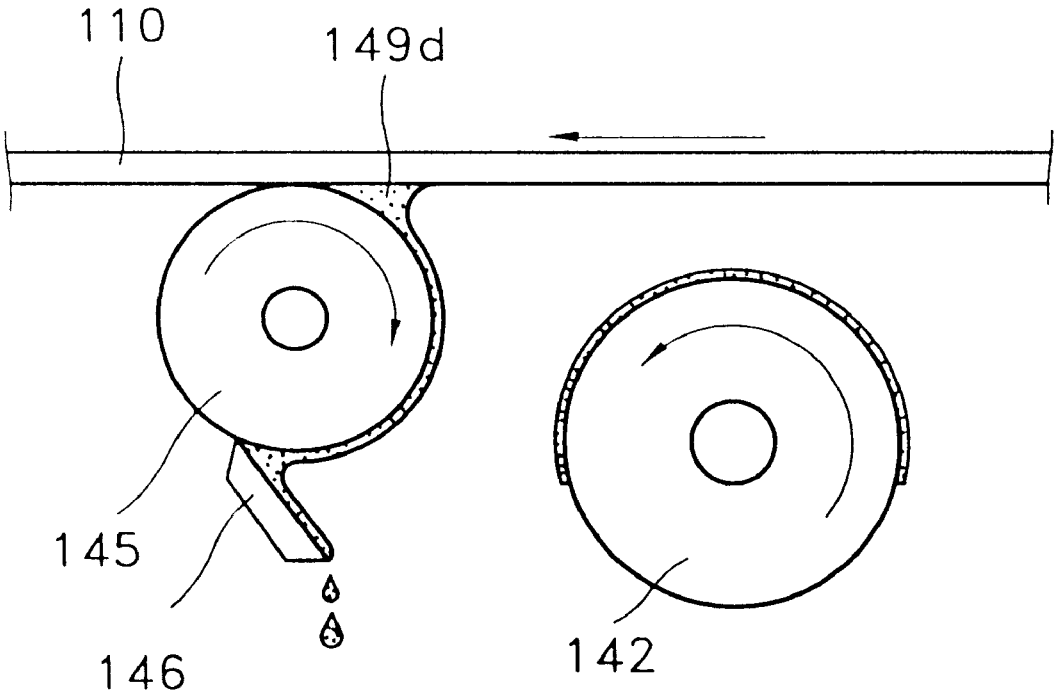
FIG.5 (PRIOR ART)
Figure 6:
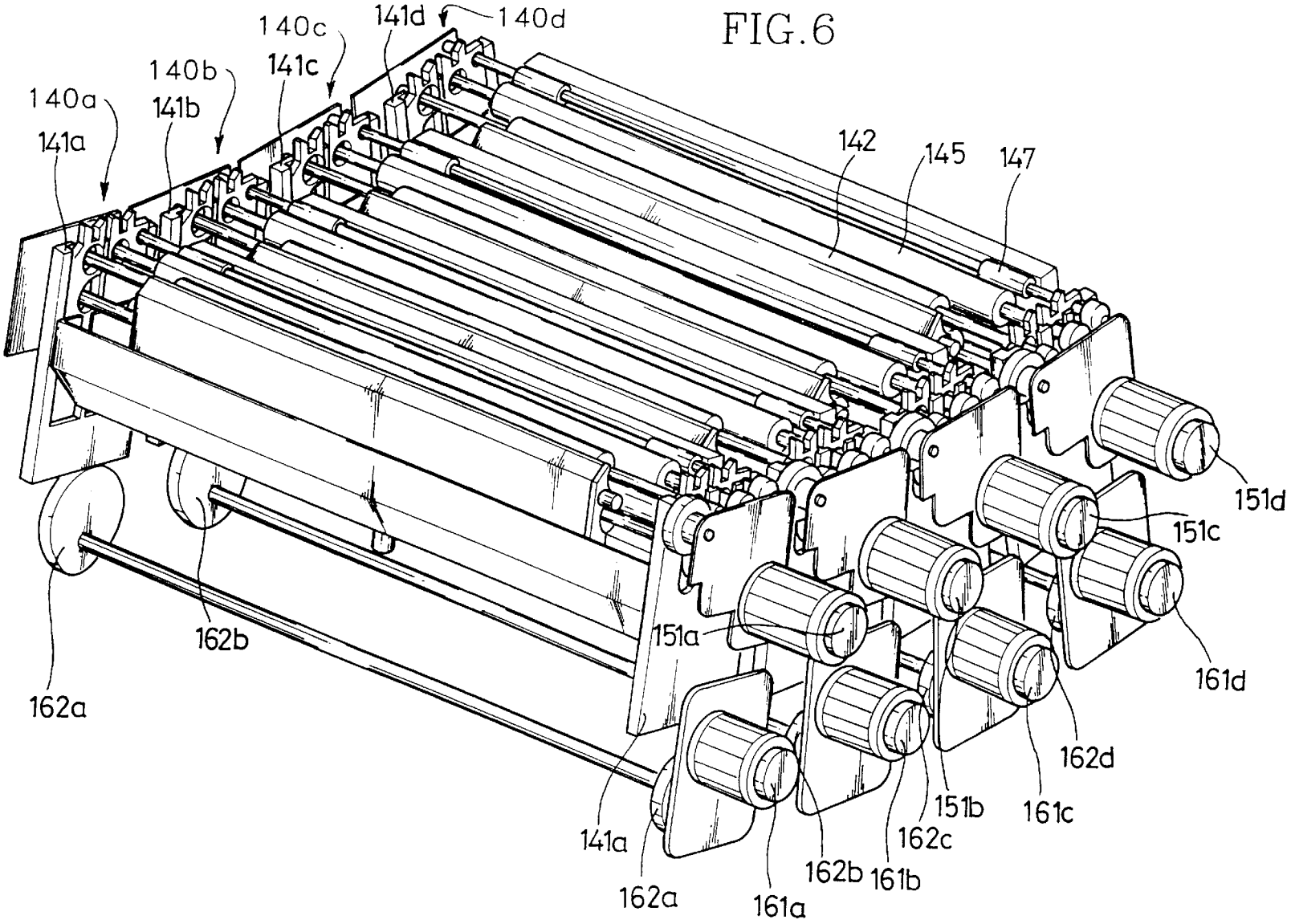
FIG. 6 is a perspective view of a conventional development device and its driver.
Figure 7:
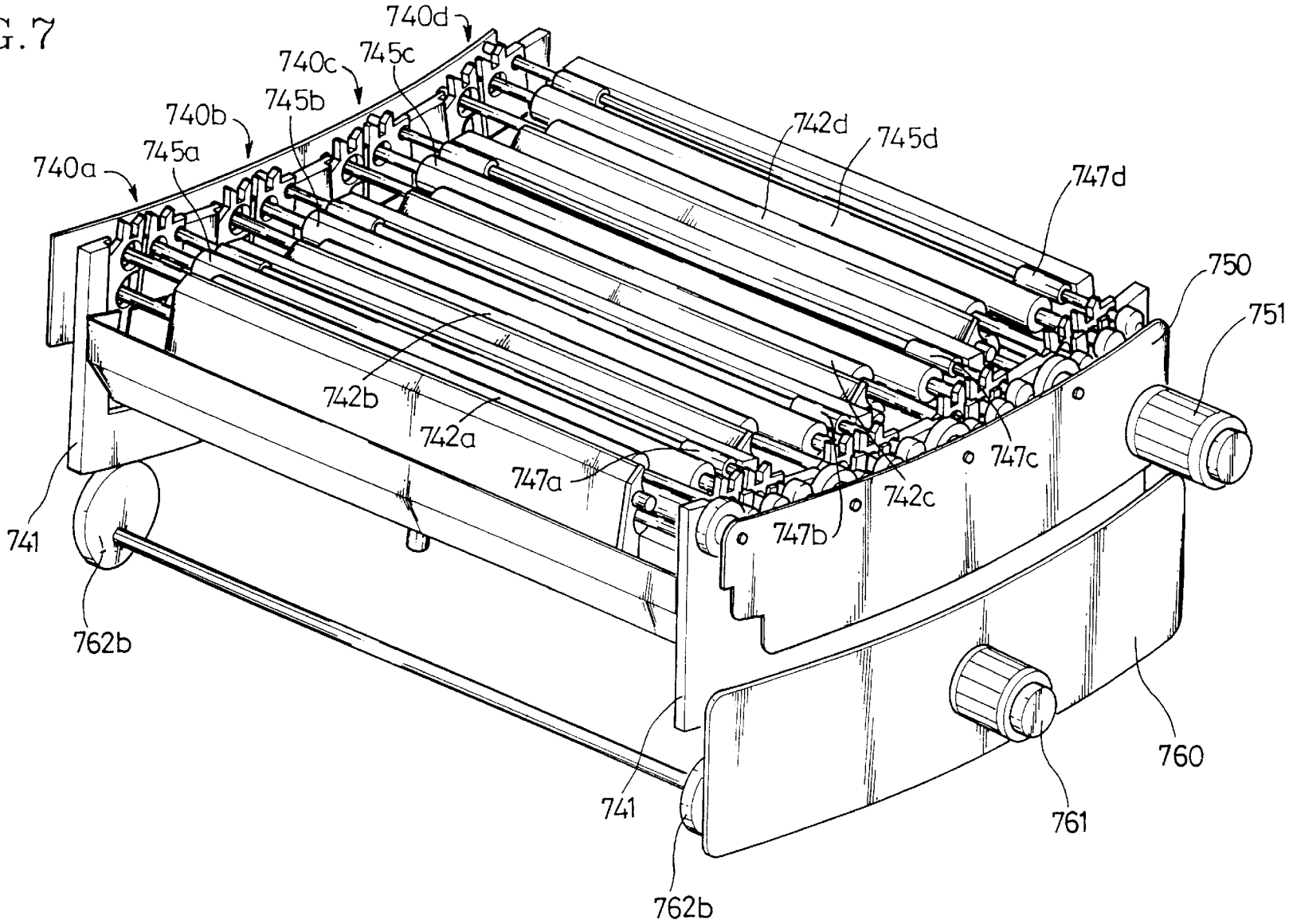
FIG. 7 is a perspective view of a development device according to the present invention.

Referring to FIG. 7, four development devices 740*a*–740*d* having development rollers 742*a*–742*d*, first squeegee rollers 745*a*–745*d*, and second squeegee rollers 747*a*–747*d* are commonly supported by a pair of frames 741 and 741 which are spaced apart a predetermined distance from each other. The development rollers 742*a*–742*d* respectively apply developer liquids having yellow (Y), magenta (M), cyan (C) and black (K) colors to the photosensitive surface of a photoreceptor belt. The first squeegee rollers 745*a*–745*d* squeegee excess developer liquid from the photosensitive region, and remove the drip line generated at the photosensitive region; while the second squeegee rollers 747*a*–747*d* squeegee the wrap-around developer liquid from the edge portions of the photoreceptor belt 110.

A first panel 750 is positioned in the vicinity of one frame 741. A roller driving motor 751, for simultaneously driving the first squeegee rollers 745*a*–745*d*, is installed on the first panel 750. A first power transmission system, for simultaneously transmitting power from the roller driving motor 751 to the first squeegee rollers 745*a*–745*d*, is provided between the frame 741 and the first panel 750.

A second panel 760 is positioned under the first panel 750. A cam driving motor 761 is mounted on the second panel 760. The cam driving motor 761 drives two sets of cams 762*a* and 762*b* which are positioned under the pair of frames 741 and 741. The rotation of the sets of cams 762*a* and 762*b* displaces the pair of frames. A second power transmission system for transmitting power from the cam driving motor 761 to the cams 762*a* and 762*b* is provided inside the second panel 760.

Figure 8:
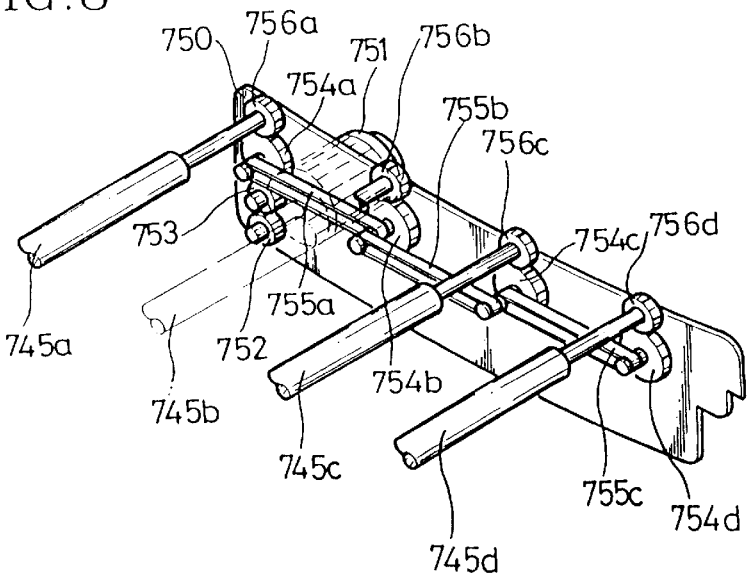
FIG. 8 is a partial perspective view of a roller driver shown in FIG. 7.

Referring to FIG. 8, the first power transmission system includes a driving gear 752 connected to the shaft of the roller driving motor 751, an idle gear 753 directly rotated by the driving gear 752, linkage gears 754*a*–754*d* linked to the idle gear 753, and driven gears 756*a*–756*d* respectively engaged with the linkage gears 754*a*–754*d*. The driven gears 756*a*–756*d* are respectively coupled to shafts of the first squeegee rollers 745*a*–745*d* of the respective development devices 740*a*–740*d*. The driven gears 756*a*–756*d* are mutually connected by timing belts 755*a*–755*c*.

As the idle gear 753 is rotated by the driving gear 752 of the roller driving motor 751, the linkage gears 754*a*–754*d* are simultaneously rotated. The driven gears 756*a*–756*d*, engaged with the respective linkage gears 754*a*–754*d*, are simultaneously rotated. Thus, the first squeegee rollers 745*a*–745*d*, engaged with the respective driven gears 756*a*–756*d*, are simultaneously rotated.

Figure 9:
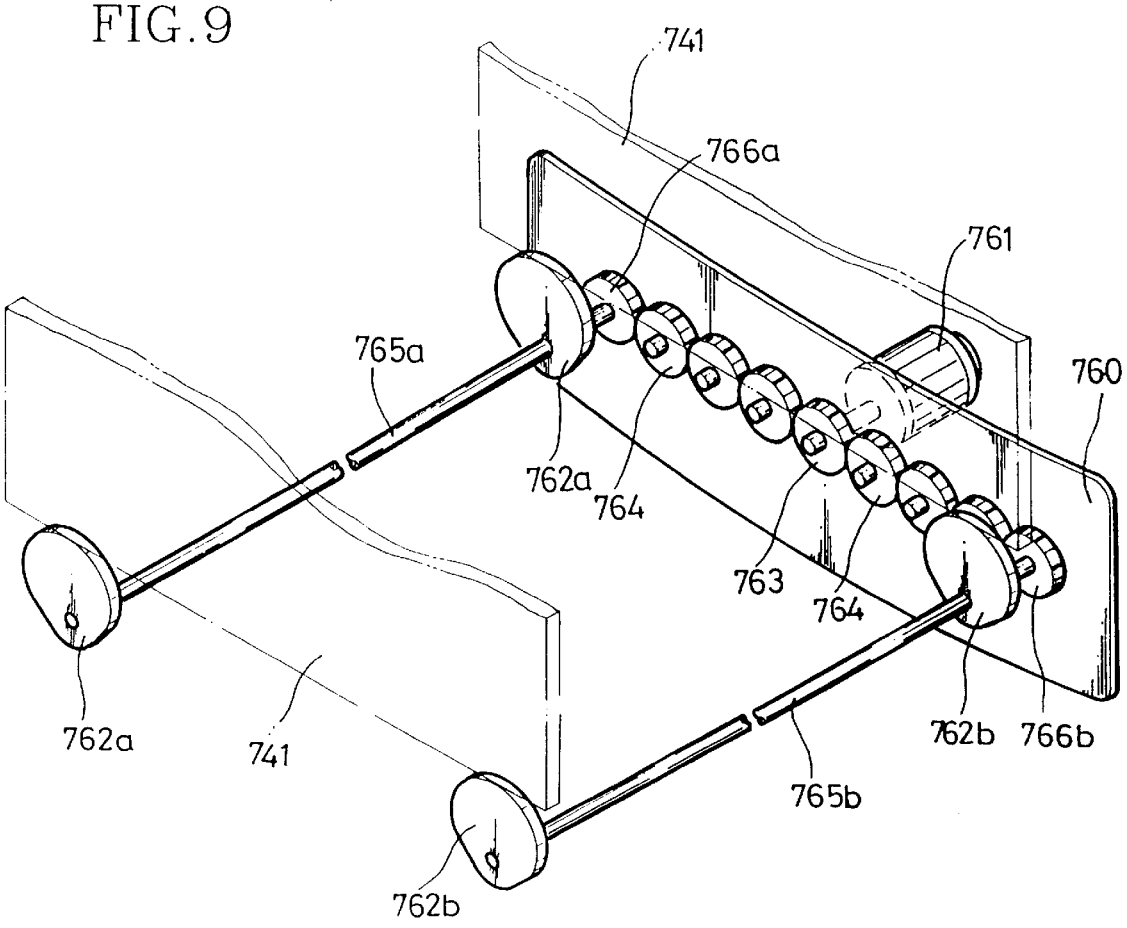
FIG. 9 is a partial perspective view of a frame elevating device shown in FIG. 7.

Referring to FIG. 9, the second power transmission system includes a driving gear 763 connected to the shaft of the cam driving motor 761. Two cam shafts 765*a* and 765*b* are installed under the frames 741 and 741. The cam shafts 765*a* and 765*b* are parallel to each other and spaced apart a predetermined distance from each other. Cams 762*a* and 762*b* are installed at both ends of the cam shafts 765*a* and 765*b*, respectively. Driven gears 766*a* and 766*b* are installed at one end of the cam shafts 765*a* and 765*b*. A plurality of idle gears 764, for transmitting a rotational force from the cam driving motor 761 to the driven gears 766*a* and 766*b*, are installed between the driven gears 766*a* and 766*b* and the driving gear 763.

When the cam driving motor 761 rotates the driving gear 763, the cam shafts 765*a* and 765*b* and their respective cams 762*a* and 762*b* rotate simultaneously. The rotational movements of the cams 762*a* and 762*b* displace the pair of frames 741 and 741 relative to the second panel 760. Accordingly, the first squeegee rollers 745*a*–745*d* of the development devices 740*a*–740*d* installed on the frames are displaced.

In the present image printing apparatus, a single driving motor is used to elevate all of the development devices. Also, the drip lines generated by the development devices are simultaneously removed by a single cam driving motor. Therefore, (1) the design and fabrication of the image printing apparatus are simplified, (2) disassembly and assembly for replacement and repair of internal parts are facilitated, and (3) the manufacturing costs are reduced.

What is claimed is:

1. An image printing apparatus comprising:

a photoreceptor belt on which a latent electrostatic image is formed;

a plurality of development devices for developing the latent electrostatic image formed on the photoreceptor belt, each of the plurality of development devices having a development roller for applying a developer liquid onto the photoreceptor belt, and a squeegee roller for removing excess developer liquid from the photoreceptor belt;

a roller driving means for driving the squeegee rollers;

an elevating means for elevating the plurality of development devices;

wherein the plurality of development devices are supported by a pair of frames spaced apart a predetermined distance from each other, the roller driving means commonly drives the squeegee rollers of the plurality of development devices, the elevating means displaces the pair of frames, such that the squeegee rollers either (1) simultaneously contact the photoreceptor belt or (2) simultaneously separate from the photoreceptor belt.

2. The image printing apparatus according to claim 1, wherein the roller driving means includes a single driving motor with a shaft for simultaneously driving the squeegee rollers.

3. The image printing apparatus according to claim 2, wherein the roller driving means includes:

a driving gear installed on the shaft of the driving motor;

a plurality of linkage gears simultaneously rotated by the driving gear; and driven gears installed on respective squeegee rollers and engaged with the linkage gears.

4. The image printing apparatus according to claim 3, further including timing belts mutually connecting the linkage gears.

5. The image printing apparatus according to claim 1, wherein the elevating means includes:

a cam driving motor with a shaft; and a plurality of cams rotated by the cam driving motor, for displacing the pair of frames.

6. The image printing apparatus according to claim 5, further including two cam shafts provided under the pair of frames and spaced apart a predetermined distance in a traversing direction of the pair of frames, wherein cams are coupled to both ends of each of the two cam shafts, such that a cam on each of the two cam shafts slidingly contacts a lower portion of each of the pair of frames.

7. The image printing apparatus according to 6, further including:

a driving gear installed on the shaft of the cam driving motor;

driven gears installed on the two cam shafts; and a plurality of idle gears, for transmitting rotational force of the driving gear to the driven gears, provided between the driving gear and the driven gears.

* * * * *